United States Patent [19]

Kempton

[11] 4,023,492

[45] May 17, 1977

[54] METALLIC-FUEL-ENHANCED, FOCUSED-GAS WARHEAD

[75] Inventor: Marvin L. Kempton, Socorro, N. Mex.

[73] Assignee: The United States of America as represented by the Secretary of the Navy, Washington, D.C.

[22] Filed: Nov. 18, 1968

[21] Appl. No.: 777,212

[52] U.S. Cl. ..... 102/66; 102/67; 102/90; 102/DIG. 2

[51] Int. Cl.[2] ..... F42B 13/48

[58] Field of Search ..... 102/24, 56, 66–68, 102/90, 22, 2

[56] References Cited

UNITED STATES PATENTS

| | | | |
|---|---|---|---|
| 2,887,953 | 5/1959 | Mager | 102/24 |
| 2,977,885 | 4/1961 | Perry et al. | 102/56 X |
| 3,212,437 | 10/1965 | Saling | 102/22 |

FOREIGN PATENTS OR APPLICATIONS

| | | | |
|---|---|---|---|
| 935,707 | 9/1963 | United Kingdom | 102/67 |

*Primary Examiner*—Verlin R. Pendegrass
*Attorney, Agent, or Firm*—R. Sciascia; R. Beers; S. Sheinbein

[57] ABSTRACT

A warhead which upon detonation imparts such high velocities to particles of magnesium that they expand outwardly faster than the gas from the explosion. The particles are positioned so that they are propelled in predetermined directions. The burning particles precondition the air thus allowing the gaseous explosion products to expand in the particle paths at a much more rapid rate than normal. Larger aluminum particles are also positioned to travel in predetermined directions upon detonation. As the magnesium particles travel outward they lose their effect on the gas cloud because of the distance between them and the expanding gas cloud. The aluminum particles then emerge from the slowing gas cloud and precondition the air to promote more rapid and further expansion of the gas cloud in the paths of the aluminum particles.

6 Claims, 5 Drawing Figures

INVENTOR
MARVIN L. KEMPTON

BY

ATTORNEY

METALLIC-FUEL-ENHANCED, FOCUSED-GAS WARHEAD

GOVERNMENT INTEREST IN THE INVENTION

The invention described herein may be manufactured and used by or for the Government of the United States of America for governmental purposes without the payment of any royalties thereon or therefor.

BACKGROUND OF THE INVENTION

1. Field of the Invention

This invention relates to focused gas warheads and, more particularly, to warheads making use of metallic fuel particles to lead the gaseous explosion products in a desired direction of expansion.

2. Description of the Prior Art

Prior art devices in which the explosive energy of an explosive charge was focused in a desired direction involved either shaped explosive charges or deflection systems which would deflect a shock wave and explosion products so that they would expand in a desired direction.

SUMMARY OF THE INVENTION

By providing metallic fuel particles to lead the gas cloud along desired paths, the present invention focuses the explosive energy of the warhead in desired directions without the use of prior art devices such as shaped charges and shock wave deflectors. The metallic fuel particles precondition the air so that the gaseous products of the explosion expand in the desired direction faster and farther than in normal warheads.

OBJECTS OF THE INVENTION

An object of the present invention is the provision of a warhead in which the gas cloud is focused in a desired direction.

Another object of the present invention is to provide a warhead containing metallic fuel which guides the expansion of the products of explosion and increases their rate and extent of expansion.

Other objects, advantages and novel features of the present invention will become apparent from the following detailed description of the invention when considered in conjunction with the accompanying drawings.

DESCRIPTION OF THE PREFERRED EMBODIMENT

Figure 1:
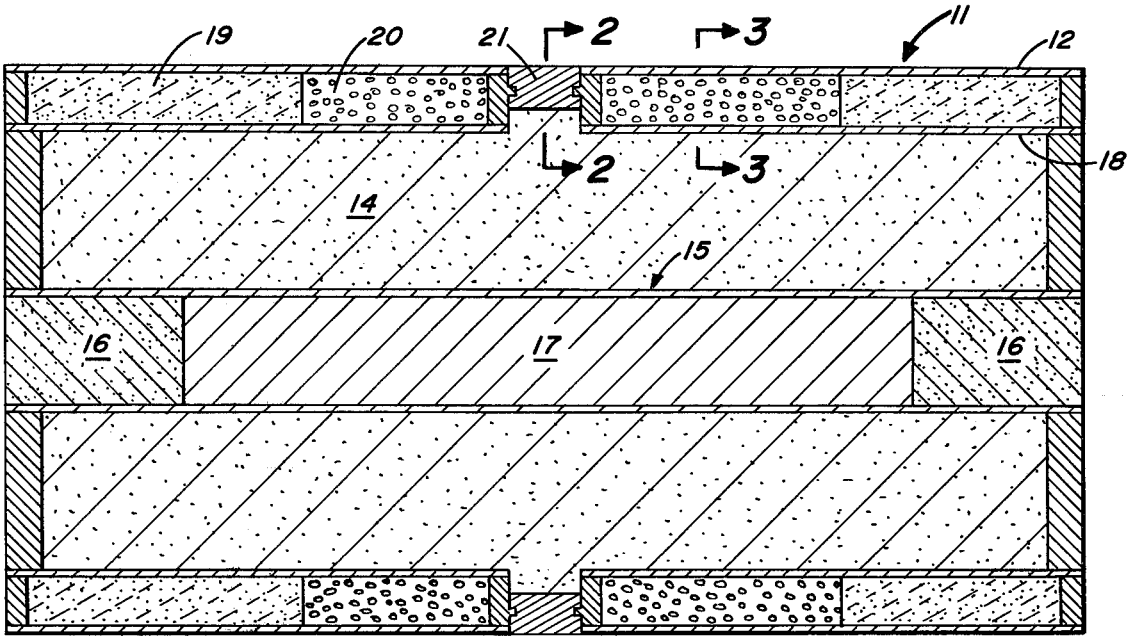
FIG. 1 shows the side cross-sectional view of a preferred embodiment of the invention.

FIG. 1 shows a warhead 11 made up on an outer casing 12 and filled with a high explosive 14. A cylindrical opening 15 is provided along the axis of the warhead and at either end of the opening 15 are provided boosters 16 used to initiate the high explosive 14.

Figure 2:
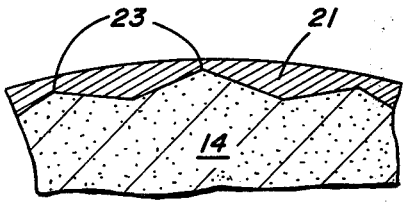
FIG. 2 shows a cross-sectional view of the magnesium insert.
Figure 3:
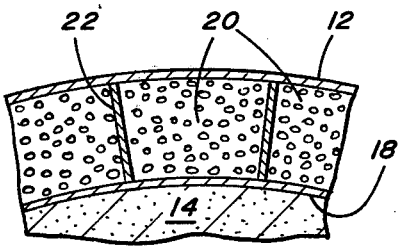
FIG. 3 shows a cross-sectional view through the aluminum spherules.

The opening 15 also provides space for a safety and arm device 17 which guards the warhead against accidental detonation. The safety and arm device is not the subject of this invention and thus will not be described in detail. An inner casing 18 parallel to outer casing 12 separates high explosive 14 from a space containing steel fragments 19 and aluminum spherules 20. The steel fragments are placed adjacent the end of the warhead and the aluminum spherules next to the steel fragments towards the center of the warhead. As best seen in FIG. 3, the space between casings 12 and 18 which contains aluminum spherules 20 is reinforced by separators 22. The separators given rigidity to the warhead and prevent the aluminum spherules from shifting. At the longitudinal center of outer casing 12 is a magnesium insert 21. As best seen in FIG. 2, magnesium insert 21 is shaped so that it will tear apart at its points of minimum thickness 23 upon detonation of the high explosive thus forming fragments. An alternate arrangement would be to provide magnesium particles or spherules rather than insert 21. Also, aluminum spherules 20 could be replaced with an aluminum insert such as magnesium insert 21.

OPERATION

The warhead is detonated by booster 16 at both ends. This produces two detonation fronts which collide at the longitudinal center of the warhead and produce a powerful outward explosion at that point. An arrangement such as this is necessary to impart the requisite extremely high velocity to the magnesium particles formed by fragmentation of insert 21. The magnesium particles must be imparted with very high velocities in order to lead the expanding gases into space and precondition the surrounding air. Experiment has shown that the burning metallic fuel particles precondition the air so that rapid expansion of the gases in the paths of the particles is induced.

The exact manner in which the metallic fuel particles precondition the air is not understood at this time. One theory is that the propagation constant of the air is changed by the heat and residue from the burning particles. Another theory is that the bow plane shock waves of the metallic fuel particles help create the preconditioning of the air.

By placing the metallic particles in a particular orientation on the warhead, their trajectory can be predetermined, and since the particles lead the gas, the primary direction of gas expansion can also be predetermined. The rate and extent of gas envelope expansion are increased more than two-fold from that of conventional types of detonation because of the above-mentioned preconditioning of the surrounding air and further because the magnesium particles are directed only into specific paths that influence the expanding gas envelope to profile itself into a geometry that does less work because the frontal area of expanding gas is smaller and thus has to push back less of the surrounding air.

Figure 4:
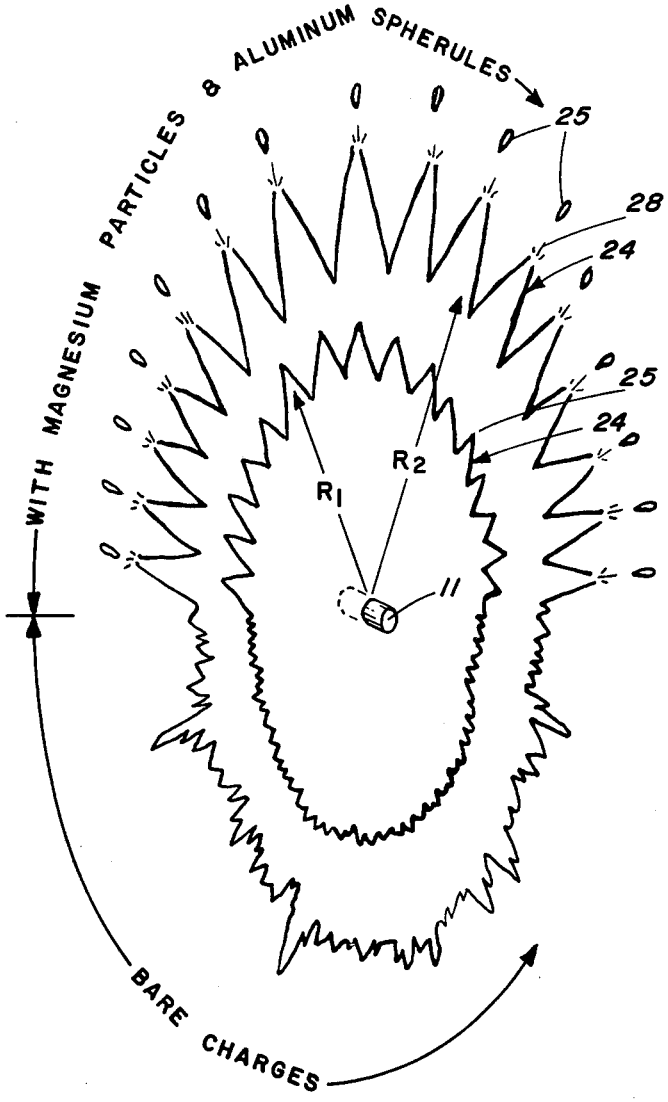
FIG. 4 shows schematically the stages in gas cloud expansion.

FIG. 4 shows schematically a warhead 11 whose top half is provided with metallic fuel particles and whose bottom half is not provided with metallic fuel particles. After gas envelope 24 has expanded to a radius of R1 (approximately 10 feet) the magnesium particles, because they are imparted with a very high velocity, emerge from the gas envelope and lead the gas into desired paths of expansion. At the same time, the lower half of gas envelope 24 is expanding more slowly because there are no metalic particles to provide leadership. As the envelope continues to expand to radius R2, the magnesium particles accelerate away from the expanding gas envelope and thereby lose their leading influence on the gas. Thus, the gas cloud begins to slow down and, at this time, the aluminum spherules emerge from the slowing gas cloud and exert the same leadership effect thereby accelerating and extending the gas cloud expansion.

Figure 5:
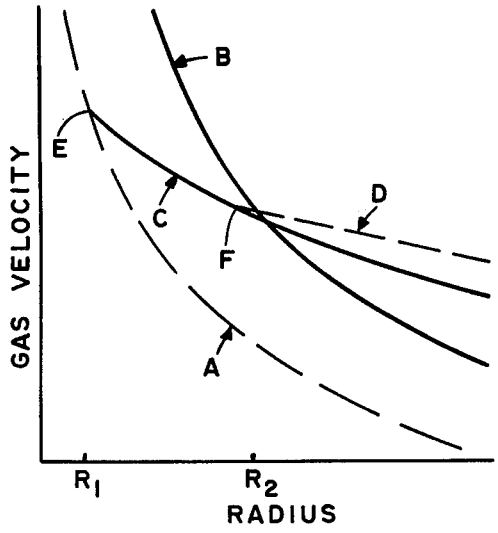
FIG. 5 is a graph comparing the velocities of gas clouds of bare charges and the gas cloud of a warhead produced according to this invention.

The graph of FIG. 5 compares the gas velocity of a charge not having metallic fuel particles with the gas velocity of a charge having metallic fuel particles. Curve A shows the relation between gas velocity and the radius of gas expansion for a charge not having metallic fuel particles. Curve C shows the relationship of gas velocity to radius of gas expansion for the same size charge having metallic fuel particles. At point E (radius R1) the magnesium particles emerge from a gas cloud and provide leadership for accelerated gas expansion. At point F (radius R2) the magnesium particles have accelerated too far ahead of the gas cloud to have any influence and the particles proceed as shown on curve D. Shortly after point F the aluminum spherules emerge from the gas cloud and provide leadership so that the gas velocity continues to be higher and the gas will expand farther than in a normal charge. Curve B represents a charge not having metallic fuel particles which is larger than the charge of curves A and C. It can be seen that the metallic fuel particles provide a smaller charge with higher velocities at large radii (and thus further gas expansion) than does even a larger charge as represented by curve B.

Thus, by employing metallic fuel particles to accelerate gas cloud expansion, the destructive effects of the gas cloud and steel or other fragments carried thereby can be greatly increased without increasing the amount of explosive used. Tests have shown that metallic fuels other than aluminum and magnesium may be used. Further, the aluminum spherules could be magnesium and the magnesium insert aluminum. These metals were used in description of the preferred embodiment by way of example rather than limitation.

Obviously many modifications and variations of the present invention are possible in the light of the above teachings.

What is claimed is:

1. A warhead comprising:

an explosive charge;

two areas of two different metallic fuels surrounding the explosive charge, the metallic fuels being in a predetermined arrangement; and means for initiating said explosive charge so that pressure created at the area of one of said metallic fuels is great enough to fragment said metallic fuel and propel the fragments faster than the gas cloud created by said explosive charge, the other metallic fuel being in an area in which lesser pressures are created.

2. A warhead according to claim 1 wherein the metallic fuel in said one area is magnesium and the metallic fuel in said other area is aluminum.

3. A warhead comprising an explosive charge;

two areas of metallic fuel surrounding the explosive charge, the metallic fuels being in a predetermined arrangement; and means for initiating said explosive charge so that pressure created at the area of one of said metallic fuels, comprising a magnesium insert, is great enough to fragment said metallic fuel and propel the fragments faster than the gas cloud created by said explosive charge, the other metallic fuel comprising aluminum spherules being in an area in which lesser pressures are created.

4. A warhead according to claim 3 wherein said explosive charge is elongated, said initiating means comprises a booster at each end of said explosive charge and said one metallic fuel area is at the center of length of said charge.

5. A warhead according to claim 4 wherein destructive fragments are also provided surrounding said explosive charge.

6. A warhead according to claim 1, wherein said metallic fuels comprise particles.

* * * * *